US005899393A

United States Patent [19]

Kröner et al.

[11] Patent Number: 5,899,393

[45] **Date of Patent: * May 4, 1999**

[54] RECYCLING OF DIAPHRAGMS

[75] Inventors: Rudi Kröner, Mannheim; Bernd Leutner, Frankenthal; Dieter Schläfer, Ludwigshafen; Wolfgang Steiner, Friedelsheim; Holger Friedrich, Bad Dürkheim, all of Germany

[73] Assignee: BASF Aktiengesellschaft, Ludwigshafen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/585,350

[22] Filed: Jan. 11, 1996

[30] Foreign Application Priority Data

Jan. 13, 1995 [DE] Germany ..... 195 00 871

[51] Int. Cl.[6] ..... B02C 19/12

[52] U.S. Cl. ..... 241/21; 241/22; 241/29

[58] Field of Search ..... 241/20, 21, 23, 241/24.11, 24.18, 29, 24.28, DIG. 38, 22

[56] References Cited

U.S. PATENT DOCUMENTS

| | | | |
|---|---|---|---|
| 2,879,005 | 3/1959 | Jarvis | 241/24.18 X |
| 3,154,255 | 10/1964 | Schulman et al. | 241/21 X |
| 3,162,380 | 12/1964 | Cohn et al. | 241/21 X |
| 3,690,569 | 9/1972 | Leverett | 241/21 X |
| 3,717,307 | 2/1973 | Beck | 241/24.18 |
| 3,726,483 | 4/1973 | Kometani et al. | 241/5 |
| 3,815,833 | 6/1974 | Vliet et al. | 241/5 |
| 3,992,350 | 11/1976 | Bensa et al. | 241/18 X |
| 4,073,661 | 2/1978 | Buzga et al. | 241/20 |
| 4,199,109 | 4/1980 | Watanabe | 241/24.18 X |
| 4,226,672 | 10/1980 | Absolon et al. | 241/21 X |
| 4,367,147 | 1/1983 | Asami et al. | 210/636 |
| 4,406,411 | 9/1983 | Gall et al. | 241/24.18 X |
| 4,526,904 | 7/1985 | Kishida et al. | 521/26 |
| 4,650,126 | 3/1987 | Feder et al. | 241/23 X |
| 4,830,188 | 5/1989 | Hannigan et al. | 241/DIG. 38 X |
| 5,133,843 | 7/1992 | Eisman . | |
| 5,156,343 | 10/1992 | Sueyoshi et al. | 241/21 X |
| 5,236,603 | 8/1993 | Sampson | 241/23 X |
| 5,255,859 | 10/1993 | Peacock et al. | 241/21 X |
| 5,363,593 | 11/1994 | HSH . | |
| 5,375,778 | 12/1994 | Lundquist | 241/20 |

OTHER PUBLICATIONS

*Chem. Abst.*, vol. 81, No. 20, Nov. 18, 1974; Abst. No. 122250 (English abstract of Levitin I.A., "Use of Radiation Reclaimed Butyl Rubber in Diaphragm Rubbers" and Tr. Mosk. Inst. Tonkoi Khim. Teknol., vol. 2, No. 1, 1972).

*Primary Examiner*—Mark Rosenbaum
*Attorney, Agent, or Firm*—Keil & Weinkauf

[57] ABSTRACT

The invention relates to a process for recycling diaphragms, in particular a process for recycling used asbestos-free diaphragms from alkali metal chloride electrolysis, the diaphragm material being comminuted, the diaphragm material being washed with a wash substrate and a reusable material being obtained.

15 Claims, No Drawings

RECYCLING OF DIAPHRAGMS

The invention relates to a process for recycling diaphragms. In particular, it is aimed at a process for recycling used asbestos-free diaphragms from alkali metal chloride electrolysis.

The electrolysis of aqueous solutions of NaCl or KCl (alkali metal chloride electrolysis) is of great industrial importance for obtaining many different products. In industry, alkali metal chloride electrolysis is primarily used to obtain chlorine and sodium hydroxide solution. In order to obtain a sodium hydroxide solution which is as free of chloride as possible, several processes are available. In the diaphragm process, cathode and anode spaces are separated by a diaphragm which consists, for example, of fibers entangled in one another. Conventional diaphragm materials consist essentially of asbestos. Recently, diaphragms have also been employed which consist of chemically inert synthetic materials.

These diaphragms become unusable after several months or years of operation, as impurities deposit in the diaphragm. These impurities lead, for example, to hydrogen occurring on the anode side. The cell has to be switched off, and the diaphragm is removed and added to the landfill. Apart from the fact that at regular intervals new diaphragms have to be prepared, which are produced from new, expensive diaphragm material, storage and disposal costs additionally accumulate for the diaphragms removed. No process is known from the prior art to reuse used diaphragm material.

It is an object of the invention to avoid said disadvantages in the disposal of used diaphragms, in particular to provide a process which can be specifically employed with asbestos-free diaphragm materials, and avoids the high storage and disposal costs, in particular in connection with special landfills.

We have found that this object is achieved according to the invention by providing a recycling process for the diaphragm material, as is defined in claim 1. The process is distinguished in that the diaphragm material is comminuted, and the diaphragm material is washed with a wash substrate, in particular a wash solution, a reusable material being obtained.

As preferred diaphragm materials, polyfluorohydrocarbons such as polyvinylidene fluoride, polytetrafluoroethylene (PTFE) or polychlorotrifluoroethylene may be mentioned here. For the purpose mentioned, fibers or fibrils of polychlorotrifluoroethylene or PTFE are suitable which contain up to 80% by weight of an inorganic hydrophilic material, e.g. $ZrO_2$ or titanium dioxide. The typical mean fiber length (measured as a maximum of the fiber length distribution) of the starting material to be processed is in the range 0.25–0.5 mm. The mean fiber length in the recycling process according to the invention is typically reduced by from 5 to 80%, in particular by from 25 to 50%. The typical fiber diameter of the starting material to be processed, which can be produced by any desired process, is in the range 0.05–100 $\mu$m. Special fibers can also have a length of 2–30,000 $\mu$m, in particular of 1,000–7,000 $\mu$m, and a diameter of 1–1000 $\mu$m, in particular of 10–100 $\mu$m. The fibers used can also be irregularly shaped, branched fibrils. These fibers do not lose their shape as a result of the recycling process, but are shortened by from about 5 to 80%.

By washing the diaphragm material, iron-containing residues especially can also be reduced or removed.

This process is preferably employed in order to recycle asbestos-free diaphragm material, preferably diaphragm material from alkali metal chloride electrolysis. Suitable diaphragms for carrying out the recycling process according to the invention are in particular those which have been prepared by deposition of a suitable fibrous material (fibrils) on the cathode of the electrolysis cell, e.g. diaphragms of titanium dioxide-containing polychlorotrifluoroethylene fibers or Polyramix® fibers from Oxytech. The latter are fibers which consist essentially of PTFE (about 20%) and zirconium oxide (about 80%).

An advantageous further development of the process proposes that the comminution is carried out in at least one stage, preferably in several stages, in particular that the diaphragm material is comminuted to fiber size. The diaphragm mats detached from the cathode are dried and comminuted such that preferably finely divided, fibrous material is available for the subsequent washing. This fiber size is typically in the range 2–10,000 $\mu$m, in particular in the range 0.5–5 mm. In order to achieve this, the number of individual comminution stages and the type of comminution in the individual stages can be suited to the economic and technical requirements.

Preferably, the process comprises several comminution steps, in particular a coarse comminution and a finer comminution. This is particularly advantageous if the detached diaphragm mats have to be stored in between a coarse precomminution or transported before a finer comminution can take place, since the coarsely precomminuted material can be handled better in transfer processes, in particular the precomminution serves to facilitate the operating procedures on charging the mill in which the breaking-up into fibers takes place. As a result of a first coarse precomminution in which the surface area of the diaphragm material has been increased, the drying process, for example, can also be shortened. The finer comminution can particularly comprise a cutting in which the diaphragm material is comminuted to fiber size.

The process according to the invention advantageously proposes that the diaphragm material is washed after at least one comminution stage and then again comminuted in at least one stage. By this means, diaphragm material obtained, for example, after a pre-comminution is subjected to a first washing, large amounts of deposits, which, for example, can contain iron compounds, already being removed here. The material thus obtained now takes up less space, so it can be more economically transported, in particular more easily pneumatically transported, and stored.

A preferred embodiment of the invention proposes a process in which the diaphragm material is dried after washing and before the subsequent comminution. This intermediate drying is particularly advantageous if the type of mill employed for the breaking-up into fibers yields more usable fibers from a technical point of view using dried diaphragm pieces. The process according to the invention can advantageously be refined by first subjecting dry diaphragm material to the various comminution stages and then washing and, if desired, additionally rewashing the finely divided (fibrous) material obtained in this process. After washing, the diaphragm material is separated from the washing solution by filtration and additionally rewashed several times with water. The filter cake can then be employed without further treatment for the production of a new diaphragm, or else dried after washing. In the former case, a working step is saved by immediate processing without drying. For example, in the case in which it is wished additionally to store the material before processing, the storage weight can be reduced and thus storage costs can be saved by drying. In particular, if required the amount necessary in each case can now be comminuted to the fiber size according to the technical requirements and even employed without further purification for diaphragm production.

The process according to the invention can advantageously be refined by the comminution only comprising a coarse comminution, the coarse comminution preferably producing diaphragm elements having a mean particle size of 5–25 mm, in particular one of not under 3 mm. If desired, after additional washing the diaphragm material thus obtained can be economically stored and transported.

It is furthermore provided according to a particular embodiment of the process according to the invention that at least one stage of the comminution is carried out in a mill. As a result of breaking up into fibers in the mill, the diaphragm material can be comminuted to fiber size.

In a further preferred embodiment of the process according to the invention, inorganic material is added to the comminuted diaphragm material. By adding of in inorganic material, preferably an inorganic solid, the functionality of the recycled diaphragms can be significantly improved. Especially preferred is the adding of an inorganic solid with a certain distribution of the size of particles. By adding the inorganic solid to the comminuted diaphragm material or the fibres, respectively, in first place the behaviour with the difusion through the diaphragm is controlable, that means that the difusion of the brine through the recycled diaphragm can be reduced. With this, the behaviour of the recycled diaphragms with respect to the difusion can be set to a technically required value.

It is especially preferred that materials or solids, respectively, are employed as inorganic material which are hardly soluble in an aqueous solution, which do not react with fluorine plastics and which are preferably stable over a large scale of pH values (pH approximately from 2 to 14). Thus, materials which are suitable as inorganic materials are oxides, silicates, carbides, sulfates, borides, silicones, nitrides. It is preferred to use oxides of titanium, vanadium, cromium, zirconium, molybdenum, hafnium, tungsten, tantalum, niobium, and these substances can either be used pure or as a mixture. The inorganic solids are either extremely pure or technical substances. It is specially preferred to use zirconium oxide since it is very stable under the conditions of the alcali metal chloride electrolysis.

In a further preferred embodiment of the present invention, the inorganic material is mixed with the comminuted diaphragm material, especially the inorganic material is added to a slurry made of the comminuted diaphragm material. The addition of for instance zirconium oxide can either be accomplished by a simple mixing with the fibres. It is, however, preferred to make a slurry from the comminuted diaphragm material, that means the fibres, in which the inorganic material is then mixed. This slurry can afterwards be used for producing the diaphragms, for instance by means of vacuum deposition.

It is preferred to add the inorganic material to the washed, comminuted diaphragm material. The used amount of inorganic material is determined preferably in dependence of the distribution of particle sizes of the inorganic material or the mixture of anorganic solids, respectively, and in dependence of the technical requirements which the recycled diaphragm has to meet. It was for instance found that amounts of 5 to 50 parts in weight of zirconium oxide, preferably 10 to 45 parts in weight of zirconium oxide, per 100 parts in weight of fibres—wherein these values refer to the dried mass of the fibres—lead to a desired reduction of the diffusion of the brine through the diaphragm. Diaphragms, which have been made from a material without any addition of zirconium oxide, for instance have a diffusion of the brine through the diaphragm of approximately 0.1 to 0.3 $m^3/hm^2$. By adding of approximately 30% of zirconium oxide of the given particle size distribution, this value can be reduced to approximately 0.02 to 0.05 $m^3/hm^2$. Thus, the diffusion can be reduced by a factor of 4 to 10.

In an embodiment of the present invention it is especially preferred to use zirconium oxide with the following distribution in particle sizes: The particles are mainly—that means more than 90%, preferably more than 99% of the particles—smaller than 100 $\mu$m, preferably smaller than 40 $\mu$m, in their largest extension. Preferably, material is employed in which the upper limit of the particle size of 10% of the particles ranges between 0.3 and 0.9 $\mu$m, for 50% of the particles ranges between 0.9 and 3 $\mu$m and for 90% of the particles ranges between 3 and 20 $\mu$m, wherein the values of the percentages refer to the volume of the anorganic material. It is especially preferred to have an upper limit of the particle size for 10% of the particles in the range of 0.5 and 0.7 $\mu$m, for 50% of the particles in the range of I to 2 $\mu$m and for 90% of the particles in the range of 3 to 10 $\mu$m. The values of the percentages are volume percentages (Q3, i.e. the distribution of the volume, that means the sum of the volumes of all particles of a given size (diameter) or of a given range of particle size, respectively) which result from a measuring of the particle size distribution.

Preferably, an HCl-containing wash solution having an HCl concentration in the range 0.1–13 mol/l is used for washing. Owing to the hydrochloric acid, deposits which contain iron compounds can be removed.

In a preferred embodiment of the process according to the invention, the wash substrate, in particular the acidic wash solution, contains sodium chloride. This has the advantage that the brine anyway employed in the alkali metal chloride hydrolysis can be used after addition of, for example, hydrochloric acid. By means of this, costs both with respect to the disposal of the brine, and in the production of the wash solution can be reduced.

An advantageous refinement of the process proposes washing at from room temperature to the boiling point of the wash solution. The temperature to be selected is predetermined by overall economic and technical conditions, expediently, however, the wash substrate is heated to a temperature of or below the boiling point. In particular, the temperature in a wash solution can be 50–100° C.

In a further preferred embodiment of the process according to the invention, the washed diaphragm material is used for diaphragm production. Thus, the material obtained, which is present, for example, in a filter cake, can be employed without further treatment for the production of a new diaphragm. To do this, it is, for example, suspended and the mixture thus obtained is applied to the cathode as a covering layer on one side. This can be achieved by vacuum filtration, brushing or spraying. If desired, the diaphragm is then impregnated with a zirconium compound, e.g. zirconium oxychloride ($ZrOCl_2$) or a zirconium alkoxide or a solution of these compounds and then brought into contact with an aqueous sodium hydroxide solution, preferably by means of immersion, in order, for example, to precipitate water-containing zirconium oxide in the interstices of the diaphragm matrix. Finally, the preformed diaphragm is dried, preferably by heat treatment below the sintering temperature, if appropriate also with application of pressure, whereby the total strength and dimensional stability of the diaphragm is increased. After drying, the diaphragm is heated to a temperature above the sintering temperature of the synthetic material of which the fibers consist, the fibers sticking together without the pore structure of the diaphragm being destroyed.

In this manner, final storage of the diaphragm material is avoided, as the diaphragm material is fed back into the production cycle. A further advantage can be seen in the fact that no additional new diaphragm material has to be produced if diaphragms are produced from the diaphragm material recovered by the process according to the invention. Furthermore, the material can also be used in other areas, e.g. in the production of filter presses. The recovered material can be suspended, applied via the vacuum process and baked solid by appropriate action of pressure and temperature.

Preferably, the washed diaphragm material can be subjected to a further treatment, namely at least partial drying of the diaphragm material and/or at least a further washing of the diaphragm material. Thus, the washed diaphragm material can be directly dried, or the washed diaphragm material can be additionally rewashed several times with, for example, water. As a result of the rerinsing, the washing with other wash substrates and/or the drying of the diaphragm material, diaphragm material can be produced for further use in any desired starting condition.

Another advantageous further development according to the invention proposes adding a nonionic surfactant to the washed diaphragm material, the nonionic surfactant preferably being added to the diaphragm material after at least one wash and/or after drying. By this means, the suitability of the washed material for further processing is improved. This process step is particularly recommended if dry recycling material is to be employed for the production of a new diaphragm material.

Preferably, the washing of the diaphragm takes place at the end of the various comminution stages, after which the washed material is employed again in the damp condition. In this manner, the material can be economically reused, as additional drying stages can be omitted. In this process, the material is precomminuted in as dry a form as possible, then broken up into fibers, then subjected to washing and if possible employed again without drying. The already damp material can then also be more simply suspended and applied to the cathode.

Preferably, original material is admixed to the reusable material in the process according to the invention. As a result of the admixture of the original material, the quality of the reusable material can be modified in any desired manner. Thus 1–99% of the original material, in particular 10–70% by weight of the original material, can be admixed, and the mixture thus obtained can be suspended and applied to a recipient surface, preferably a cathode surface, and solidified by heating, a diaphragm being obtained.

A zirconium compound can be added to the diaphragm in the initial operating period such that, for example, water-containing zirconium oxide precipitates between the diaphragm material. In this manner, the flow of the brine can be regulated and thus a greater lifetime of the diaphragm can be achieved.

The process according to the invention is intended to be illustrated in greater detail by the following examples, which contain further preferred details of the invention.

EXAMPLE 1

A diaphragm used for alkali metal chloride electrolysis, which according to DE 27 56 720 consisted of polychlorotrifluoroethylene fibers which contain about 70% by weight of titanium dioxide (mean particle diameter<1$\mu$m) was detached from the cathode, spread out and stored at room temperature for one day.

It was then precomminuted in a suitable mill and thereafter broken up into fibers in a second mill. To remove deposits which contain, inter alia, iron compounds, 1,000 g of the fiber material were contain, inter alia, iron compounds, 1,000 g of the fiber material were boiled under reflux for one hour in 3,000 g (2.87 l) of 10% strength hydrochloric acid. The fiber material was then filtered off with suction through a frit and the filter cake was rinsed four times with 1 l of water until free of acid. A white, fibrous material remained, which still contained moisture (<10% by weight).

The recycling material thus obtained was employed for the production of a diaphragm, the same process being used which was also used in the production of the diaphragms from unused material.

EXAMPLE 2

A Polyramix® diaphragm from Oxytech used in alkali metal chloride electrolysis and consisting essentially of PTFE fibers containing 82% by weight of $ZrO_2$ was detached from the cathode of the alkali metal chloride electrolysis cell in large surface-area mats, dried at 25–50° C. for 24 hours in air, comminuted according to Example 1 and freed from impurities and deposits which also contained iron compounds by heating 1 kg of the material in 3 l of 10% strength by weight hydrochloric acid for one hour.

TABLE 1

Analytical monitoring of fiber cleaning with 10% strength by weight hydrochloric acid via the iron content

| | $ZrO_2$ content | Fe content, calculated as $Fe_3O_4$ |
|---|---|---|
| Original fibers: | 82% by weight (after dissolving out adhering NaCl) | — |
| Fibers, before washing with HCl: | 70% by weight | 2.5% by weight |
| Fibers, after washing with HCl: | 74% by weight | 0.05% by weight |
| Wash solution (1997 g): | 0.77 g (0.15% by weight of the total $ZrO_2$) | 24.6 g (98% by weight of the total $Fe_3O_4$) |

The fiber material thus obtained (solid content>90%) was used in the solid state for the production of a diaphragm by means of vacuum deposition, the same process being used which was also employed for the production of the diaphragms from unused Polyramix® fibers containing 82% by weight of $ZrO_2$.

The electrolysis of sodium chloride using a pilot plant cell which was equipped with a diaphragm of recycling material produced sodium hydroxide solution and chlorine. The cell voltage was 2.9 V. The sodium hydroxide solution at the cell exit had a sodium hydroxide concentration of 67 g/l. It was possible to obtain chlorine in a purity of 98.5% by weight.

In order to regulate the flow of brine through the diaphragm, the cell was fed in the first five hours of electrolysis with a sodium chloride solution which contained 500 ppm of zirconium oxychloride ($ZrOCl_2$).

EXAMPLE 3

Used diaphragm from alkali metal chloride electrolysis was processed according to Example 1. Differing from Example 1, the comminuted diaphragm material was covered with 3 l of boiling half-concentrated hydrochloric acid for washing and the mixture was stirred with a stirrer at a low speed of rotation (about 100 rpm) without further addition of heat for 30 minutes.

EXAMPLE 4

Polyramix® diaphragms were removed from the electrolysis cells and immediately precomminuted in a saw mill without further drying. The precomminuted diaphragm pieces (mean weight: about 1 kg) were covered with 3 l of half-concentrated hydrochloric acid heated to 90° C. and allowed to stand in a Dewar vessel for 24 hours. The acid was then decanted off and the diaphragm pieces were washed several times with water until acid-free. The rinsed pieces were dried at 120° C. for 5 hours and broken up into fibers in a mill. The fiber material was then passed through a I mm sieve in order to retain residual lumps. The recycling fibers obtained were then used for the production of a diaphragm, the same process again being employed which was also used for the production of the original diaphragms.

EXAMPLE 5

Diaphragms of Polyramix® were removed from the electrolysis cell, dried in air and precomminuted in a saw mill. Pieces having a mean diameter of about 7 mm resulted. The precomminuted material (1 kg) was boiled under reflux with a solution of 500 g of sodium chloride in 1,500 g of I molar hydrochloric acid for 1 hour and then filtered off with suction through a frit. In this manner, about 94% of the iron-containing impurities were washed out. The moist substrate was then washed with 6 l of water and subsequently stirred with 500 ml of water and 5 g of a nonionic fluorosurfactant (Fluorad® FC-171 from 3M). The aqueous solution was then largely removed by repeated filtering off through a frit. The material was then dried at 70° C. for 10 hours and broken up into fibers in a suitable mill. Further processing to give diaphragms was carried out according to Example 1.

TABLE 2

Analytical monitoring of fiber purification using 1 molar HCl solution via the iron content

| | Fe content, calculated as $Fe_2O_3$ |
|---|---|
| Fibers, before washing with HCl, dried | 3.01% by weight |
| Fibers, after washing with HCl, dried | 0.17% by weight |

EXAMPLE 6

A diaphragm was comminuted according to Example 1, washed and then dried at about 70° C. 320 g of the dry recycling material were intimately stirred with 10 g of Fluorad® FC-171 (chemically and thermally stable wetting agent based on polyfluorocarboxylic acid (derivatives) and perfluorosulfonic acid derivatives from 3M for use in electroplating) and 200 ml of water before use for forming a diaphragm on the cathode. The suspension thus formed was used for the production of a diaphragm for the electrolysis cell according to Examples 1 and 2.

A 50% solution of sodium hydroxide was added to 12.5 kg water until a pH value of approximately 11.5 was reached. In additon, 26.25 g of thickening agent on the basis of polysaccharid (Welan Gum, trademark of Kelco, Division of Merck), 26.25 g of the bacteriozide Proxel® of the company ICI, which is based on 1.2 benzisothiazin-3-on, and 3.1 g of a silicone anti foaming agent (for instance silicone antifoaming agent DB 10010A® of the company Dow Corning) were added and homogenized with a ultraturrax.

For the deposition of a diaphragm with a surface of 75 $cm^2$, 434 g of the above described solution was mixed with 34,4 NaCl, 1 g of a tenside for effecting hydrophilicity and 42.8 g of the fibres prepared according to example 2 (dry mass 65.7%=28.1g) and the suspension was mixed with a mixer. 11 g of unstabilized $ZrO_2$ with 10 % of particles smaller than 0.54 $\mu$m, 50% of the particles smaller than 1.4 $\mu$m and 90% of the particles smaller than 3.45 $\mu$m were dispersed in 20 g water and subsequently mixed into the suspension of fibres.

The slurry suspension was now applied to a cathode mash, which was covered with a nylon web having a small pore size. The solution was poured through for 30 minutes, thus building up a filter layer. Afterwards a solution was sucked through by applying a vaccum on the other side (200 mbar), and then the diaphragm was left for another 90 minutes under the suction fan.

The diaphragm resulting from this process was dried for 6 hours at 95° C. and afterwards sintered in an oven at 320 to 360° C.

We claim:

1. A process for recycling asbestos-free diaphragms, which comprises comminuting the diaphragm material, washing the diaphragm material with a wash (solution whereby a reusable diaphragm material is obtained.

2. The process of claim 1, wherein the asbestos-free diaphragm material is diaphragm material from alkali metal chloride electrolysis.

3. The process of claim 1, wherein the reusable diaphragm material is further comminuted.

4. The process of claim 1, wherein an inorganic material is added to the comminuted diaphragm material.

5. The process of claim 4, wherein the inorganic material is added to a slurry of the comminuted diaphragm material.

6. The process of claim 4, wherein the inorganic material has a distribution of particle size with a maximum smaller than 100 $\mu$m.

7. The process of claim 4, wherein 5 to 50 parts by weight of zirconium oxide per 100 parts by weight of the dry mass of the comminuted diaphragm material are used as the inorganic material.

8. The process of claim 1, wherein the comminuted diaphragm material is washed with an acid-containing aqueous solution.

9. The process of claim 1, wherein the comminuted diaphragm material is washed with an HCl-containing wash solution having an HCl concentration in the range of 0.1–13 mol/l.

10. The process of claim 1, wherein the comminuted diaphragm material is washed with a solution containing sodium chloride.

11. The process of claim 1, further comprising adding a nonionic surfactant to the reusable diaphragm material.

12. The process of claim 1, wherein the reusable diaphragm material is mixed with original diaphragm material.

13. The process of claim 1, wherein the reusable diaphragm material is impregnated with a zirconium compound.

14. The process of claim 1, wherein the reusable diaphragm material is separated from the washing solution.

15. The process of claim 16, wherein the separated diaphragm material is dried.

* * * * *

UNITED STATES PATENT AND TRADEMARK OFFICE

CERTIFICATE OF CORRECTION

PATENT NO.: 5,899,393

DATED: May 4, 1999

INVENTOR(S): KROENER et al.

It is certified that error appears in the above-identified patent and that said Letters Patent is hereby corrected as shown below:

Col. 8, claim 1, line 28, "(solution" should be --solution--.

Col. 8, claim 15, line 63, "16" should be --14--.

Signed and Sealed this

Twenty-first Day of September, 1999

*Attest:*

Q. TODD DICKINSON

*Attesting Officer*

*Acting Commissioner of Patents and Trademarks*